US010597846B2

(12) United States Patent
Zent et al.

(10) Patent No.: US 10,597,846 B2
(45) Date of Patent: Mar. 24, 2020

(54) SYSTEM AND METHOD FOR POSITIONING A LIFT ARM ON A POWER MACHINE

(71) Applicant: Clark Equipment Company, West Fargo, ND (US)

(72) Inventors: Kevin J. Zent, Bismarck, ND (US); Trevor W. Krause, Bismarck, ND (US); Jonathan J. Roehrl, Bismarck, ND (US); Marty Carpenter, Bismarck, ND (US)

(73) Assignee: Clark Equipment Compmany, West Fargo, ND (US)

( * ) Notice: Subject to any disclaimer, the term of this patent is extended or adjusted under 35 U.S.C. 154(b) by 39 days.

(21) Appl. No.: 15/958,459

(22) Filed: Apr. 20, 2018

(65) Prior Publication Data

US 2018/0238017 A1 Aug. 23, 2018

Related U.S. Application Data

(63) Continuation-in-part of application No. 15/142,991, filed on Apr. 29, 2016, now Pat. No. 9,951,494.
(Continued)

(51) Int. Cl.
*E02F 3/43* (2006.01)
*E02F 9/20* (2006.01)

(52) U.S. Cl.
CPC ..... *E02F 3/433* (2013.01); *E02F 3/432* (2013.01); *E02F 3/436* (2013.01); *E02F 9/2041* (2013.01)

(58) Field of Classification Search
CPC ..... E02F 3/433; E02F 3/432; E02F 9/2014; E02F 3/436
(Continued)

(56) References Cited

U.S. PATENT DOCUMENTS

2009/0185888 A1 7/2009 Lin et al.
2011/0150614 A1* 6/2011 Nicholson ..... E02F 3/431 414/685
(Continued)

FOREIGN PATENT DOCUMENTS

CN 102829007 A 12/2012
CN 102829008 A 12/2012
(Continued)

OTHER PUBLICATIONS

International Search Report and Written Opinion dated Jul. 21, 2016 for International Application No. PCT/US2016/030197 filed Apr. 29, 2016, 16 pages.
(Continued)

*Primary Examiner* — Marthe Y Marc-Coleman
(74) *Attorney, Agent, or Firm* — John D. Veldhuis-Kroeze; Westman, Champlin & Koehler, P.A.

(57) ABSTRACT

A method of controlling a lift arm actuator and a tilt actuator to control positioning of an implement carrier coupled to a lift arm of a power machine. An activation signal is received from an enabling input device. A lift arm control signal is received from a lift arm control input commanding movement of the lift arm. The lift arm actuator is controlled responsive to receipt of both of the activation signal and the lift arm control signal to move the lift arm to a target lift arm position and to move the implement carrier to or maintain the implement carrier at a target implement carrier orientation relative to a gravitational direction.

12 Claims, 10 Drawing Sheets

Related U.S. Application Data

(60) Provisional application No. 62/154,389, filed on Apr. 29, 2015.

(58) Field of Classification Search
USPC ..... 701/50
See application file for complete search history.

(56) References Cited

U.S. PATENT DOCUMENTS

| | | | | |
|---|---|---|---|---|
| 2012/0323451 | A1 | 12/2012 | Shatters et al. | |
| 2013/0045071 | A1 | 2/2013 | Atkinson | |
| 2014/0178166 | A1 | 6/2014 | Andruch, III et al. | |
| 2016/0273196 | A1* | 9/2016 | Funk | E02F 9/265 |
| 2016/0319509 | A1 | 11/2016 | Zent et al. | |

FOREIGN PATENT DOCUMENTS

| | | | |
|---|---|---|---|
| EP | 0258819 | A1 | 3/1988 |
| EP | 2535464 | A2 | 12/2012 |
| WO | 2016/176615 | A1 | 11/2016 |

OTHER PUBLICATIONS

International Search Report and Written Opinion dated Jul. 29, 2019 for International Application No. PCT/US2019/027631 filed Apr. 16, 2019, 12 pages.

Chinese Office Action with English Translation dated Oct. 12, 2019 for Chinese Application No. 201680024787.2, 28 pages.

* cited by examiner

SYSTEM AND METHOD FOR POSITIONING A LIFT ARM ON A POWER MACHINE

CROSS-REFERENCE TO RELATED APPLICATIONS

This application claims the benefit of U.S. Provisional Application No. 62/154,389, filed Apr. 29, 2015 and U.S. application Ser. No. 15/142,991 filed Apr. 29, 2016.

BACKGROUND

This disclosure is directed toward power machines. More particularly, this discussion is directed toward power machines with lift arms that are capable of carrying a work implement as well as systems and methods for positioning the work implement by controlling the position of the lift arms. Power machines, and more particularly, loaders, have long had lift arms that can carry work implements such as buckets and the like for performing various work tasks. Operators of these machines can advantageously manipulate lift arms carrying such implements to perform various tasks. Not only would an operator have the ability to manipulate the position of the lift arms (known generally as a lift operation), but also to manipulate a position of the work implement with respect to the lift arm (known generally as a tilt operation).

One example of such a task is a digging and loading operation, where an operator may be digging soil with a bucket and then dumping the soil in a truck bed. To perform this task, the operator will have to position the implement via lift and tilt operations to place the bucket in a position to dig soil and then position the implement again to dump the soil into a truck bed. Repetitive positioning of the implement requires that the operator repeatedly concentrate on precisely controlling the lift arm to place the bucket in the dig position and the dump position.

In addition, raising and lowering the lift arms of a power machine and particularly a loader by manipulating one or more lift arm actuators can change the angle of the implement with respect to gravity over the lift arm path of certain loaders. That is, if the path of the lift arm is not perfectly vertical, simply raising or lowering the lift arm will change the orientation of the implement with respect to gravity unless the implement is also tilted with respect to the lift arm. This can cause material contained within a bucket, for example, to spill out during the raising or lowering process. This relationship between an implement and gravity can be further changed if the power machine is travelling over uneven terrain.

SUMMARY

The present disclosure is directed toward methods and systems for selectively controlling the position of an implement mounted to a lift arm to direct the implement to a pre-selected position. In addition, the present discussion is directed toward methods and systems for selectively maintaining a consistent orientation between an implement and gravity.

In one embodiment, a method of controlling a lift arm actuator and a tilt actuator to control positioning of an implement carrier coupled to a lift arm of a power machine is disclosed. The method includes receiving an activation signal from an enabling input device and receiving a lift arm control signal from a lift arm control input commanding movement of the lift arm. The method further includes controlling the lift arm actuator and the tilt actuator responsive to receipt of both of the activation signal and the lift arm control signal to move the lift arm to a target lift arm position and to move the implement carrier to or maintain the implement carrier at a target implement carrier orientation relative to a gravitational direction.

In another embodiment, a power machine is disclosed. The power machine has a frame, a lift arm pivotably coupled to the frame, and a lift arm actuator coupled between the frame and the lift arm to control movement of the lift arm relative to the frame. An implement carrier is pivotably coupled to the lift arm and a tilt actuator is coupled between the lift arm and the implement carrier to control movement of the implement carrier relative to the lift arm. A power source is in communication with each of the lift arm actuator and the tilt actuator and configured to provide power source control signals to control the lift arm actuator and the tilt actuator. An enabling input device is configured to be manipulated by a power machine operator to provide an activation signal, a lift arm control input is configured to be manipulated by the power machine operator to provide a lift arm control signal and a tilt control input is configured to be manipulated by the power machine operator to provide a tilt control signal. An implement orientation sensor is configured to provide an output indicative of an orientation of the implement relative to a gravitational direction. A controller is coupled to the enabling input device to receive the activation signal, to the lift arm control input to receive the lift arm control signal, to the tilt control input to receive the tilt control signal, and to the implement orientation sensor to receive the output indicative of the orientation of the implement relative to the gravitational direction. The controller is further coupled to the power source to control the power source control signals and thereby control the lift arm actuator and the tilt actuator. The controller is further configured to control the lift arm actuator and the tilt actuator responsive to receipt of both of the activation signal and the lift arm control signal to move the lift arm to a target lift arm position and to move the implement carrier to or maintain the implement carrier at a target implement carrier orientation relative to a gravitational direction.

In another embodiment, a method of controlling a lift arm actuator and a tilt actuator to control positioning of an implement carrier coupled to a lift arm of a power machine is disclosed. The method includes, the method receiving an activation signal from an enabling input device and receiving a lift arm control signal from a lift arm control input commanding movement of the lift arm. The method further includes controlling the lift arm actuator and the tilt actuator, responsive to the receipt of both of the activation signal and the lift arm control signal, to move the lift arm to a target lift arm position and to move the implement carrier to or maintain the implement carrier at a target implement carrier orientation relative to a gravitational direction. The speed of movement of the lift arm is controlled based upon the lift arm control signal indicating an amount of actuation of the lift arm control input.

In another embodiment, a method of positioning an implement that is operably coupled to a lift arm of a power machine is disclosed. The method includes receiving a target mode activation signal from an enabling input device indicative of an operator's intention to enter a target mode and receiving a lift arm control signal from a lift arm control input indicative of an operator's intention to move the lift arm, and receiving a lift arm position signal indicative of a position of the lift arm. The method enters the target mode, responsive to reception of both of the target mode activation signal and the lift arm control signal indicative of the operator's intention to move the lift arm. In the target mode, a lift arm actuator is controlled to move the lift arm relative to a frame of the power machine toward, but not beyond, a target lift arm position. When in the target mode, receiving one of the lift arm position signal indicating that the lift arm has reached the target lift arm position and the lift arm control signal indicating an intent to stop moving the lift arm will cause an exiting of the target mode and a controlling of the lift arm actuator to stop movement of the lift arm.

In another embodiment, a power machine is disclosed. The power machine has a frame, a lift arm pivotably coupled to the frame, and a lift arm actuator coupled between the frame and the lift arm to control movement of the lift arm relative to the frame. A power source is in communication with the lift arm actuator and configured to provide power source control signals to control the lift arm actuator. An enabling input device is configured to be manipulated by a power machine operator to provide a target mode activation signal. A lift arm control input is configured to be manipulated by the power machine operator to provide a lift arm control signal indicative of an operator's intention to move the lift arm. A controller coupled to the enabling input device to receive the target mode activation signal and to the lift arm control input to receive the lift arm control signal. The controller is coupled to the power source to control the power source control signals and thereby control the lift arm actuator. The controller is further configured to enter a target mode, responsive to reception of both of the target mode activation signal and the lift arm control signal indicative of the operator's intention to move the lift arm. In the target mode, the controller is configured to control the lift arm actuator to move the lift arm relative to a frame of the power machine toward, but not beyond, a target lift arm position. The controller is further configured when in the target mode such that, upon the lift arm reaching the target lift arm position or upon receiving the lift arm control signal indicating an intent to stop moving the lift arm, the controller responsively exits the target mode and controls the lift arm actuator to stop movement of the lift arm.

In another embodiment, a method of positioning of an implement that is operably coupled to a lift arm of a power machine is disclosed. The method includes receiving an activation signal from an enabling input device and controlling a tilt actuator to attain and maintain a preset orientation of the implement relative to a gravitational direction, responsive to receipt of the activation signal.

In another embodiment, a method of positioning of an implement that is operably coupled to a lift arm of a power machine is disclosed. The method includes setting a target orientation for the implement indicative of a desired orientation of the implement with respect to gravity and receiving a signal indicative of the orientation of the implement, wherein the signal indicates that the orientation varies from the target. The method controls a tilt actuator to attain and maintain the target orientation without any input from an operator indicating a desire to move the lift arm or the implement.

This Summary and the Abstract are provided to introduce a selection of concepts in a simplified form that are further described below in the Detailed Description. The Summary and the Abstract are not intended to identify key features or essential features of the claimed subject matter, nor are they intended to be used as an aid in determining the scope of the claimed subject matter.

DETAILED DESCRIPTION

The concepts disclosed in this discussion are described and illustrated with reference to exemplary embodiments. These concepts, however, are not limited in their application to the details of construction and the arrangement of components in the illustrative embodiments and are capable of being practiced or being carried out in various other ways. The terminology in this document is used for the purpose of description and should not be regarded as limiting. Words such as "including," "comprising," and "having" and variations thereof as used herein are meant to encompass the items listed thereafter, equivalents thereof, as well as additional items.

The present application is directed toward a system and method for positioning an implement that is operably coupled to a lift arm. In particular, the present application is directed toward disclosing systems and methods of selectively controlling a tilt actuator for controlling the orientation of an implement with respect to the lift arm in response to an input from an operator to position the lift arm. In one aspect of this disclosure, the tilt actuator of the power machine is selectively actuated to maintain a constant orientation with respect to gravity as the lift arm is moved in either direction along its defined path. In another aspect of this disclosure, the lift and tilt actuators are selectively actuated to return to a pre-defined position in response an input from an operator to position the lift arm.

Figure 1:
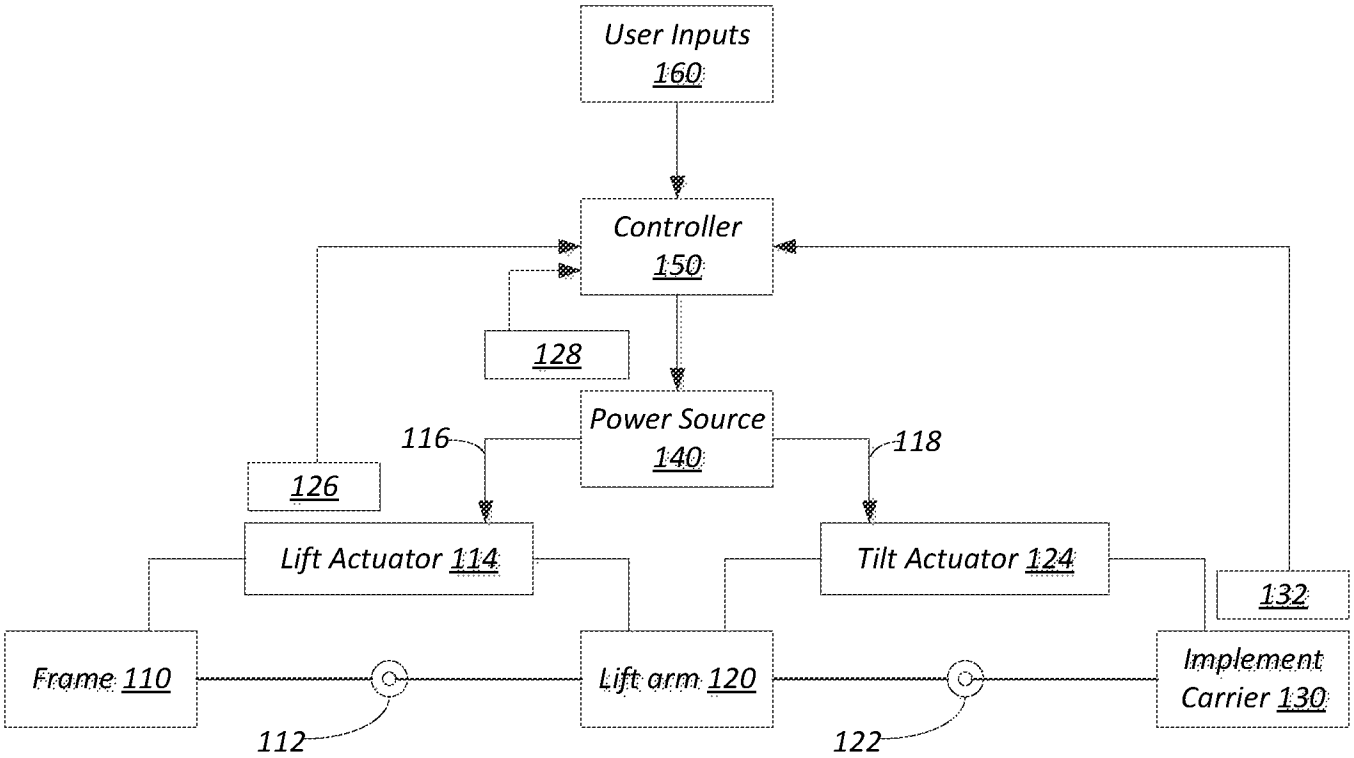
FIG. 1 is a block diagram illustrating components of a power machine that is capable of positioning an implement mounted to a lift arm according to one illustrative embodiment.

FIG. 1 is a block diagram that illustrates a power machine 100 according one illustrative embodiment. The power machine 100 has a frame 110 to which a lift arm 120 is pivotally attached. An implement carrier 130 pivotally attached to the lift arm 120. The implement carrier 130 is capable of carrying an implement such a bucket or a variety of other implements to perform various work tasks. While the power machine 100 illustrated in FIG. 1 has implement carrier 130, other embodiments of power machines can have an implement pivotally attached to a lift arm, that is, attached directly to the lift arm without an implement carrier. For the purposes of simplicity, embodiments herein are discussed with reference to an implement carrier. It should be appreciated that any reference to an implement carrier herein should not be considered to be an exclusion of those embodiments where a power machine does not have an implement carrier unless explicitly stated as much.

The lift arm 120 is pivotally attached to the frame at a pivoting joint 112. A lift actuator 114 is attached to the frame 110 and the lift arm 120 and is actuable to move the lift arm 120 with respect to the frame. The lift arm 120 can be of any suitable geometry and can include multiple segments. For example, the lift arm 120 can be a radial lift arm, rotatable about the frame 110 at a single joint such as joint 112. Alternatively, the lift arm 120 can include multiple segments attached to the frame 110 at multiple positions. For example, in some embodiments, lift arm 120 can have three separate sections and be attached to the frame 110 at two locations such that the lift arm and the frame form a four-bar linkage. The representation of rotatable joint 112 in FIG. 1 should be understood to mean that the lift arm 120 is rotatable with respect to the frame 110 and should not be understood to limit the geometry of any lift arm that may be employed in embodiments that include various features described herein. Similarly, implement carrier 130 is pivotally attached to lift arm 120 via a joint 122. By pivoting the lift arm 120 with respect to the frame 110 and the implement carrier 130 with respect to the lift arm, an implement that is attached to the implement carrier can be positioned to perform a work function.

FIG. 1 illustrates a lift actuator 114 that is operably coupled to the frame 110 and the lift arm 120. Although not explicitly shown in FIG. 1, the lift actuator 114 can be pivotally mounted to either or both of the frame 110 and the lift arm 120. Lift actuator 114 is capable of moving or rotating the lift arm 120 relative to the frame 110 under power. Likewise, tilt actuator 124 is operably coupled to the lift arm 120 and the implement carrier 130 (either or both couplings can be pivotal mountings) for moving or rotating the implement carrier 130 with respect to the lift arm 120. Power signals 116 and 118 are selectively provided from power source 140 to each of the lift actuator 114 and the tilt actuator 124, respectively, to cause the lift arm 120 to move with respect to the frame 110 and the implement carrier 130 to move with respect to the lift arm 120. In one embodiment, the lift actuator 114 includes a pair of hydraulic cylinders, mounted to either side of the frame 110 and to the lift arm 120 that act in concert to position the lift arm relative to the frame. Similarly, the tilt actuator 124 includes a pair of hydraulic cylinders, each mounted to the lift arm and the implement carrier 130 that act in concert to position the implement carrier with respect to the lift arm 120.

Power source 140, in one embodiment, includes an internal combustion engine (not shown), which supplies power to a hydraulic pump (not shown). The hydraulic pump, in turn, provides pressurized hydraulic fluid to a control valve assembly (not shown), which in turn is capable of providing independent power signals 116 and 118 to the lift actuator 114 and the tilt actuator 124. Various arrangements of power sources can be used to power lift and tilt actuators without departing from the scope of this discussion. A controller 150 is in communication with the power source 140 for controlling the provision of power signals 116 and 118 to the lift and tilt actuators 114 and 124. A plurality of user inputs 160 are provided for manipulation by an operator. The user inputs 160 are in communication with the controller 150 and are capable of providing signals indicative of any manipulation by an operator. The user inputs 160 can be manipulated by an operator to control the position of the lift arm 120 and/or the implement carrier 130 as will be discussed in more detail below.

Sensors are provided to sense operating conditions and provide signals indicative of the sensed operating conditions to the controller 150. A lift position sensor 126 is provided for effectively sensing the position of the lift arm 120. In one embodiment, lift position sensor 126 senses the position of the lift actuator 114. More particularly, in embodiments where the lift actuator 114 is a hydraulic cylinder, lift position sensor 126 senses how far a rod of such a hydraulic cylinder is extended. On the other hand, implement carrier orientation sensor 132 does not measure the exact relationship between the implement carrier 130 and the lift arm 120, but rather, the relationship between the implement carrier and gravity. Stated another way, orientation sensor 132 provides a measurement indicative of the relationship or orientation of the implement carrier with respect to a direction of Earth's gravitational force acting on the power machine, implement carrier and any attached implement. This relationship advantageously allows the controller 150 to maintain the implement carrier 130, and by extension, an attached implement, at a constant or known orientation, even when the power machine is traveling over or positioned on an uneven or inclined surface.

However, because the actual relationship between the lift arm and the implement carrier 130 (or, in the case of some embodiments where a power machine doesn't have an implement carrier, the lift arm and the implement) is not known, in certain conditions, it may be possible that an attempt to maintain a constant level, the tilt actuator (in some embodiments, a hydraulic cylinder) may reach end of travel. In such an instance, power source 140 may attempt to continue to provide a power signal 118 to the tilt actuator 124. Providing pressurized hydraulic fluid to a hydraulic cylinder that has reached end of stroke can result in a pressure buildup, causing the system to go over relief and potentially preventing the power source 140 from providing a power signal 116 to the lift actuator. Pressure sensor 128 measures pressure at one of a number of possible locations within the power source 140 for sensing pressure to determine when the power system has built up sufficient pressure to open a relief valve. By eliminating the signal to the tilt cylinder when pressure sensor 128 senses a high level (above a threshold pressure), hydraulic power is not wasted and can be advantageously used on other functions on machine, most notably to power the lift cylinder, but the added power can impact travel speed and other functions as well.

Figure 2:
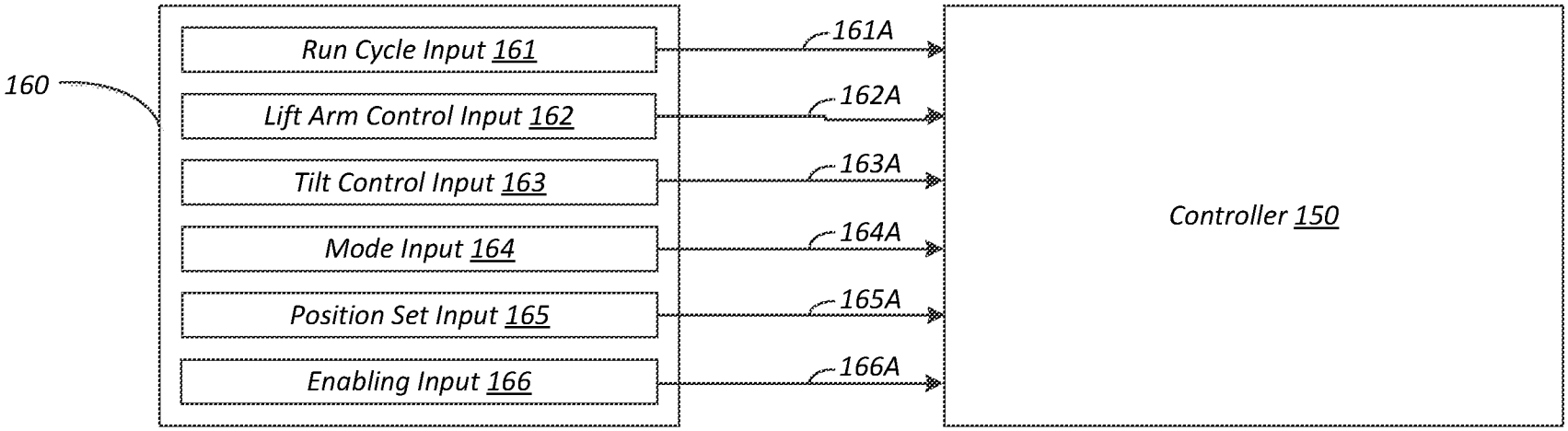
FIG. 2 is a block diagram detailing operator inputs in the power machine of FIG. 1.

FIG. 2 illustrates some of the user inputs 160 that are provided to the controller 150 for controlling the actuation of the lift actuator 114 and the tilt actuator 124. A run cycle input 161 provides a run cycle signal 161A to controller 150. The run cycle signal 161A indicates to the controller 150 an intention by an operator to use the power machine. In one embodiment, the run cycle input is a key switch that as at least an off position and an on position. The controller 150 receives the cycle signal 161A and determines based on the input when the beginning of a run cycle begins (i.e. when the key switch is moved to the run position from the off position). The controller 150 also determines the duration of a run cycle. In one embodiment, a run cycle continues from when the run cycle signal 161A first indicates a run cycle until the run cycle signal 161A no longer indicates a run cycle. In other embodiments, the run cycle input 161 can be a plurality of input devices such as momentary push button devices that are operable to provide the run cycle signal 161A.

A lift arm control input 162 can be manipulated by a user to provide an indication of a direction and speed that an operator wishes to move lift arm 120. The lift arm control input 162 in one embodiment is moveable along a single axis (or one axis of a two-axis joystick) and biased to a neutral position, so that movement in one direction away from the neutral position signifies an intention to raise the lift arm, with the distance moved from the neutral position indicating a speed at which the lift arm should be raised. Movement in the other direction away from neutral signifies an intention to lower the lift arm, with again the distance moved from neutral indicating a speed at which the lift arm should be lowered. Thus, the lift arm control input provides a speed component and a direction component. A lift arm control signal 162A indicative of the position of the lift arm control input 162 is provided to the controller 150.

Another of the user inputs 160 that is illustrated in FIG. 2 is a tilt control input 163. The tilt control input 163 in one embodiment is moveable along a single axis and biased to a neutral position, so that movement in one direction away from the neutral position indicates an intention to rotate the implement carrier 130 in one direction relative to the lift arm 120 and movement of the tilt control input 163 in the other direction away from the neutral position indicates an intention to rotate the implement carrier 130 in the opposite direction relative to the lift arm 120. A signal 163A indicative of the position of the tilt control input 163 is provided to the controller 150. In one embodiment, the lift control input 162 and the tilt control input 163 are incorporated into a single two-axis input device, with one of axes serving as the lift arm control input 162 and the other of the axes serving as the tilt control input 163. Like the lift arm control input, the tilt control input 163 has a speed component, and a direction component. In other embodiments, the lift arm control input and the tilt input can be incorporated into separate input devices.

In addition to the lift arm and tilt control inputs, a number of other operator input devices are provided for selective control of the lift and tilt functions. A mode input device 164 provides an actuation signal 164A to controller 150. Mode input device 164 can be a momentary push button device or any suitable input device that, when actuated, signals an intention by an operator to change the mode of operation or control of the lift arm and tilt functions. Various modes of operation will be discussed in more detail below, but briefly, the controller 150 will control the position of the lift arm 120 and the implement carrier 130 differently based on the signals provided from the operator inputs 160 to the controller 150 depending on the selected mode.

In one embodiment, the operator inputs 160 also include a position set input device 165. The position set input device 165 can be a momentary push button device or any other suitable input device. The position set input device 165 provides a signal 165A indicative of manipulation thereof to the controller 150. When the signal 165A indicates that the position set input device 165 has been manipulated, a return position is defined based on the position of the lift arm 120 and the orientation of the implement carrier 130 at the time that the manipulation of the set input device 165. In some embodiments, a single position or target is capable of being set. This target position can include information about a desired position of the lift arm, the orientation of the tilt, or both. In other embodiments, a plurality of targeted positions can be implemented. This is described in more detail below.

Once a return or target position is set, the controller 150 is capable of selectively moving the lift arm 120 and the implement carrier 130 to the target position, at least in some instances, and under some circumstances. An enabling input 166 is actuable to provide an enabling input signal 166A to controller 150. In certain modes known as a target mode, the controller 150 would, in response to the enabling input signal 166A, allow the lift arm 120 and the implement carrier 130 to be controlled so as to direct the lift arm and the implement carrier to the return position. The enabling input 166, would not, by itself in some embodiments, command the controller 150 to move the lift arm 120 and the implement carrier 130 to the return position, but would enable the controller 150 to move the lift arm and implement carrier, in response to one or more other operator inputs, toward the target position, and stop movement of the lift arm and implement carrier when the return position is reached, assuming no other intervening actions have occurred.

Figure 3:
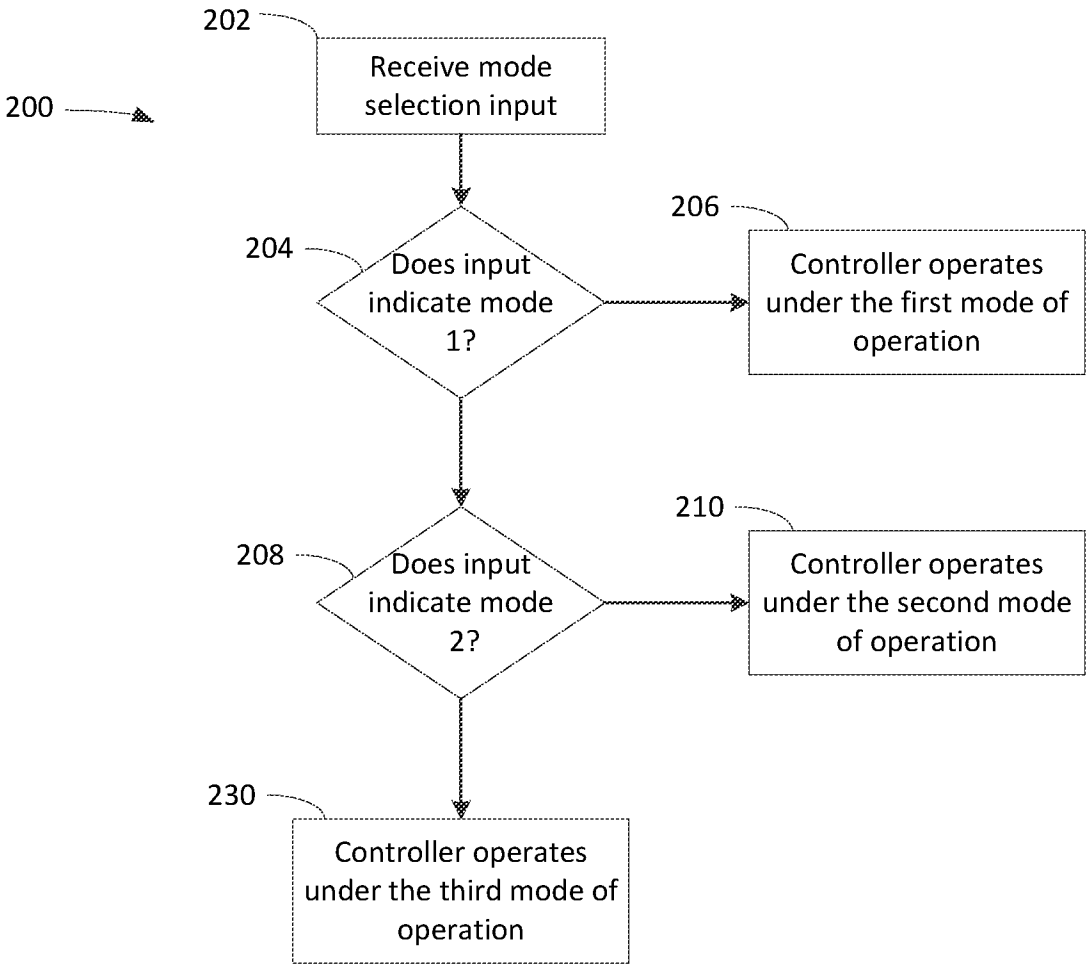
FIG. 3 is a flow chart illustrating a method of selecting a mode of operation for controlling a lift arm and/or implement carrier according to one illustrative embodiment.

As discussed above, the controller 150 is configured to operate in a number of different modes of operation. FIG. 3 illustrates a method 200 of selecting a mode of operation for controlling the lift and tilt actuators of a power machine such as power machine 100. The method 200 is described with reference to power machine 100 for ease of explanation, but the method 200 can be incorporated with other power machines as well. At block 202, a mode signal 164A for selecting a mode of operation is received from mode input 164. Based on the mode signal received, the controller 150 will select and operate under one of three modes. At block 204, the method determines whether the mode signal 164A indicates a first mode. If the first mode is indicated, the method moves to block 206 and the first mode is selected. In some embodiments, the first mode is the default mode. Operation of the lift arm actuator and the tilt actuator in the first mode is discussed in more detail below. If the first mode is not indicated, the method moves to decision block 208. At decision block 208, having previously determined that the mode signal 164A is not indicative of the first mode, the method 200 now determines whether the mode signal 164A is indicative of the second mode or the third mode. If the mode signal 164A is indicative of the second mode of operation, the method moves to block 210 and selects and operates under the second mode of operation. If the mode signal 164A is indicative of the third mode of operation, the method moves to block 230 and operates under the third mode of operation. The selection of a particular mode of operation can be accomplished in any suitable manner. For example, the mode input device 164 can be a single input device that can be repeatedly actuated to cycle through different modes. Alternatively, the mode input device 164 can be a plurality of devices, each of which is dedicated to a specific mode or a single input device having multiple positions, each corresponding to a specific mode.

In one embodiment, the mode selection can be selected only once in a run cycle, such as at the beginning of the run cycle. Alternatively, an operator can have the ability to select the mode at any time during a run cycle or change the mode at any time during a run cycle.

First Mode of Operation

When the operator has selected the first mode of operation (which may be the default mode of operation, i.e. the mode of operation when the operator does not make a selection), movement of the lift arm 120 is controlled by signals 162A from the lift arm control input 162 and movement of the implement carrier 130 is controlled by signals 163A from the tilt control input 163. The first mode is a traditional mode of operation. In other words, actual movement of the lift arm 120 is controlled solely by actuation of the lift arm control input 162 and the actual movement of the implement carrier 130 is controlled solely by the tilt control input 163. No control decisions with respect to the movement of the lift arm are based on the position of the lift arm, the orientation of the implement carrier, or any signal received from the tilt control input 163. Likewise, no control decisions with respect to the movement of the implement carrier are based on the position of the lift arm, the orientation of the implement carrier, or any signal receive from the lift control input 162. That is, operation of the lift and tilt functions have no regard for any target or pre-set position or orientation.

It should be appreciated that some power machines may have methods of enablement that must be satisfied before any movement of a lift arm and/or an implement carrier may be allowed. The discussion here regarding the first mode (and subsequent modes below) assumes that if such enablement requirements exist, that they have been satisfied before receiving control signals from the lift arm control input and the tilt control input.

Second Mode of Operation

Figure 4:
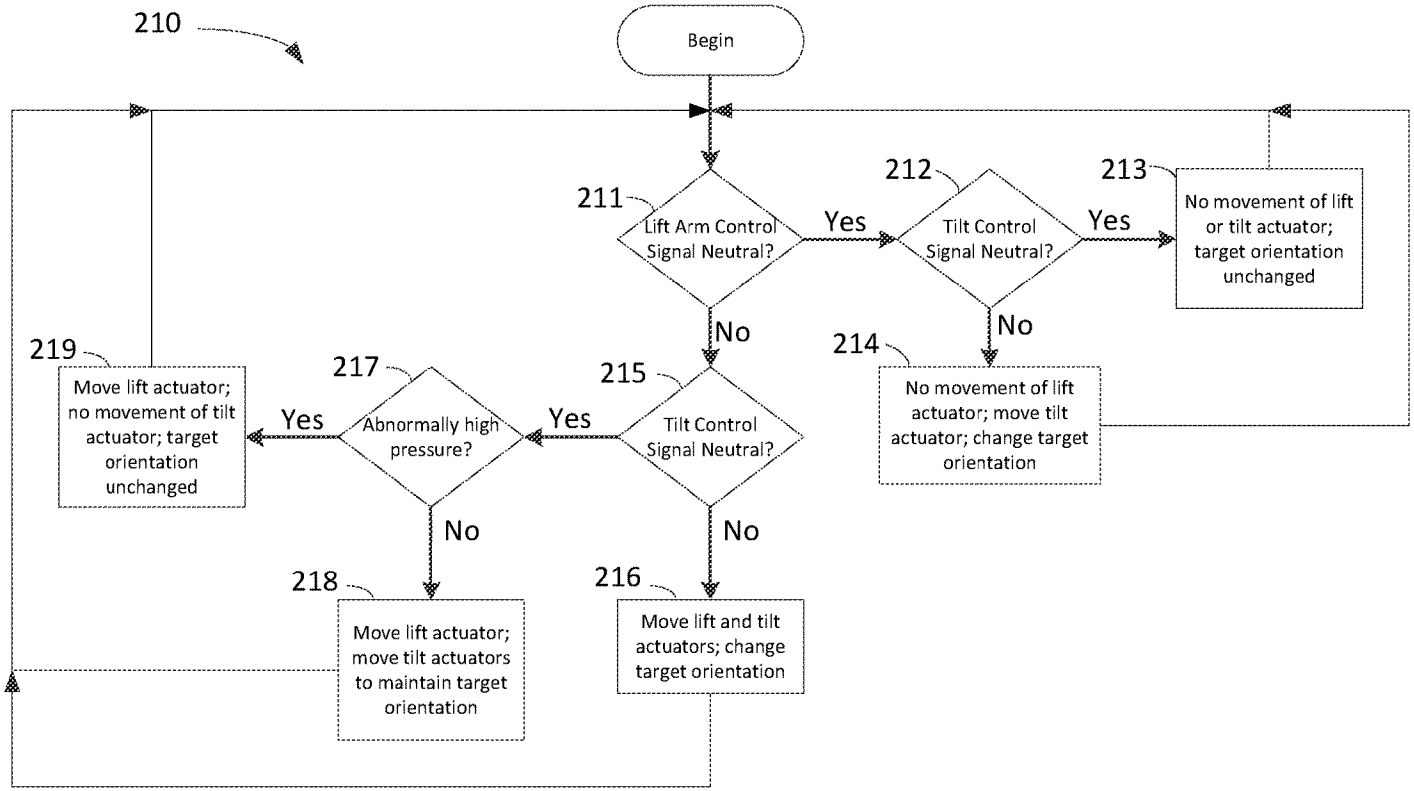
FIG. 4 is a flow chart illustrating a portion of the method of FIG. 3 when the method is operating in a second mode of operation.

When the operator has selected a second mode of operation, movement of the implement carrier 130, in some instances, is performed independent of the tilt control input 163 so that the implement carrier maintains a constant orientation with respect to gravity by actuating the tilt actuator 124 to maintain the implement carrier at a target position. FIG. 4 illustrates the portion of method 200 represented by block 210 of FIG. 3 in more detail. For the purposes of this disclosure, the second mode of operation can be considered a target mode of operation, meaning that in some circumstances, as discussed immediately below, movement of the tilt actuator 124 is or can be constrained by one or more pre-set target positions.

When in the second mode of operation, the controller 150 monitors the signals provided by the lift arm control input device 162, the tilt control input device 163, and the pressure sensor 128, and based on the signals provided from these inputs, controls the lift actuator 114 and the tilt actuator 124.

At block 211, the controller 150 determines whether the lift arm control input signal 162A is indicating a neutral signal. A neutral signal indicates that the operator is neither requesting that the lift arm be raised or lowered. In other words, the lift arm control input 162 is not being manipulated. If it is determined that the lift arm control signal 162A is indicating a neutral signal, the method moves to block 212 to determine whether the tilt control input signal 163A is likewise indicating a neutral signal. If the tilt control signal 163A indicates a neutral signal, the method moves to block 213. At block 213, the controller 150 provides no movement signal to either of the lift or the tilt actuator and the target orientation of the implement carrier is unchanged. Alternatively, the controller can monitor the orientation of the implement carrier 130 by reading the implement carrier orientation sensor 132 and adjust the tilt actuator if the actual orientation does not match the target orientation because, for example, the power machine has moved to an uneven or inclined position.

Returning to block 212, if the controller 150 determines that the tilt control signal is not in a neutral position, the controller 150 sends an appropriate tilt control signal 118 to actuate the tilt actuator 124, while the lift actuator 114 is not actuated. This is shown at block 214. As the tilt actuator moves the implement carrier 130, the target orientation is changed to reflect the actual orientation of the implement carrier 130. In other words, an operator can change the target orientation of the implement carrier 130 simply by powering the implement carrier to a desired orientation. No other operation is necessary to set the target orientation. As the machine moves over uneven terrain, the orientation of the tilt can change, even though the tilt cylinder is not being actuated. In some embodiments, this new orientation will become the target orientation, and the method will adjust to this target orientation accordingly. Alternatively, in this mode and in others (i.e. the third mode discussed below), as the machine moves over uneven terrain, the controller 150 can sense that the orientation of the implement or tilt has changed and command the tilt actuator to move to maintain the target orientation, if possible. It may not be possible to do so if the tilt function is limited geometrically. In such a case, as is discussed below a pressure signal will indicate that the tilt function has reached an endpoint beyond which it cannot move.

Returning to block 211, if the controller 150 determines that the lift arm control signal 162 is providing a signal to actuate the lift arm actuator 114 (i.e. it is not in a neutral position), the method moves to block 215, where the controller 150 analyzes the tilt control signal 163A. If the tilt control signal is also not in neutral, the method moves to block 216, where the controller 150 actuates the lift and tilt actuators 114 and 124, just as it would in a similar situation in the first mode. In addition, however, the controller 150 will change the target orientation to match the actual orientation of the implement carrier 130.

If at block 215, the controller 150 determines that the tilt control signal 163A is a neutral signal, the method intends to maintain the target orientation of the implement carrier 130 as the lift arm 120 moves up or down whenever possible. The method moves to block 217 to determine whether it is possible to maintain the target orientation. At block 217, the controller determines whether the pressure sensor 128 is providing a signal indicative of an abnormally high pressure (e.g., a pressure above a predetermined threshold). In some circumstances, the geometric limitations of the lift arm 120 and the implement carrier 130 make it impossible to maintain the target orientation of the implement carrier 130 as the lift arm 120 is raised or lowered because the tilt actuator 124 has reached an end of travel condition (e.g., a hydraulic cylinder has reached a stop). Because the controller 150 does not know the actual position of the implement carrier 130 relative to the lift arm 120, the controller 150 monitors the pressure signal from the pressure sensor 128. In some embodiments, when the tilt actuator 124 reaches an end of travel condition, continuing to try and actuate the actuator will cause a high pressure condition. For example, if a hydraulic cylinder has reached the end of travel, continuing to apply an actuation signal will cause the hydraulic pressure to rise. In some embodiments, such as when the power source 140 employs an open center series control valve to provide control signals 116 and 118 to the lift and tilt actuators 114 and 124, respectively, such a high pressure condition will not only result in the inability to maintain the target orientation, but will actually prevent the lift actuator from moving as desired.

Thus, at block 215, the pressure signal is measured (effectively only after the control signals 116 and 118 are activated). If the pressure is not abnormally high, the method moves to block 218, where the controller 150 actuates the lift actuator 114 in response to the signal provided by the operator and moves the tilt actuator 124 to maintain the target orientation. If, however, the pressure is abnormally high, the method moves to block 219, where the controller stops actuating the tilt actuator 124 and continues to actuator the lift actuator. In this instance, the target orientation remains unchanged. The block 210 continues to operate for as long as the method 200 is in the second mode.

Third Mode of Operation

When the operator has selected a third mode of operation, the operator is allowed to select one or more target positions to which the implement carrier 130 can be positioned. For the purposes of this disclosure, at times during the third mode of operation the method can enter what is referred to as a target mode. More particularly, when the operator is using the lift arm control input to drive to a target position as described herein, that operation is a target mode operation. Referring briefly again to FIG. 2, the controller 150 receives a position set signal 165A from position set input device 165 for setting one or two positions and an enabling input signal 166A from enabling input device 166. This third mode allows an operator to energize a return to position feature, which will advantageously return the implement carrier to a pre-defined position without requiring that the tilt control input 163 be actuated by the operator. Furthermore, the operator will have the option of selecting a pre-defined position or two separate pre-defined positions to which the implement carrier 130 can be returned. For the purposes of this disclosure, returning the implement carrier 130 to a pre-defined position includes controlling both the lift actuator 114 and the tilt actuator 124 to position the implement carrier at the correct height by actuating the lift arm actuator and the correct orientation by actuating the tilt actuator.

Figure 5:
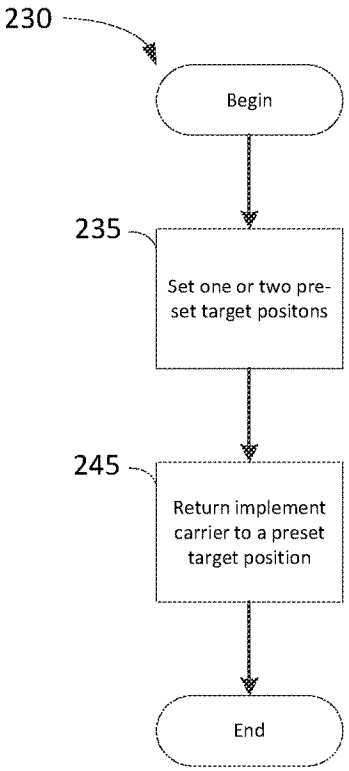
FIG. 5 is a flow chart illustrating a method of controlling a lift arm and/or implement carrier when the method is operating in a third mode of operation as shown in FIG. 3.

FIG. 5 illustrates a method of controlling the lift arm 120 and implement carrier 130 under the third mode of operation, designated by block 230 of FIG. 3. In block 235, the operator sets the position or positions to which the operator will be able to return the implement carrier 130. In one embodiment, the one or two stored or pre-set target positions are reset at the beginning of every run cycle. In alternative embodiments, they can be reset on command, or carried over from one run cycle to the next. Once the operator has set up the position or positions, the operator can initiate a return to position procedure, as shown in block 245.

Figure 6:
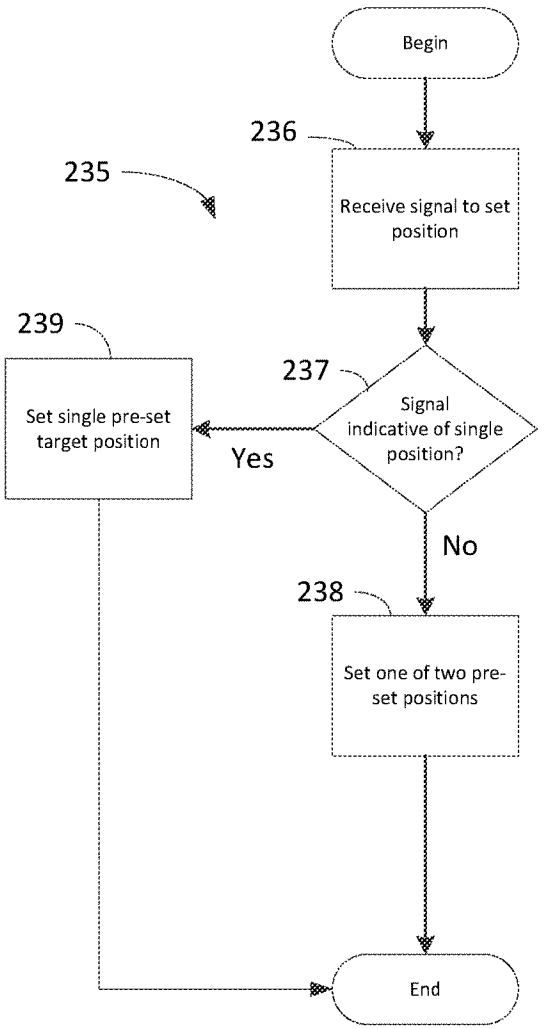
FIG. 6 is a flow chart illustrating a portion of the method of FIG. 5 where an operator selects whether one or two pre-set target positions are to be saved.

FIG. 6 illustrates the process of setting the position or positions to which the operator will be able to return the implement carrier 130 as outlined in block 235 of FIG. 5 in more detail according to one illustrative embodiment. At block 236, the controller 150 receives a set position indication to set the current position of the implement carrier 130 as a return position. The set position indication includes at least an indication from the position set input device 165 via set input signal 165A, as is shown in FIG. 2. The set position indication indicates not only that the current position is to be saved as a pre-set condition, but also whether the current position is to be set as a single position or one of two positions. At block 237, the determination is made whether the set position indication is for a single pre-set target position or one of two pre-set target positions. If the controller 150 determines that the current position is to be saved as a single pre-set condition, the method moves to block 239 and saves a single pre-set condition, and the controller 150 is capable only of returning to that one position. In some embodiments, the controller 150 can send an indication to a display to alert the operator that a single position has been set.

If at block 237, the controller 150 determines that the set position indication is for one of two pre-set target positions, the method moves to block 238, where the controller 150 saves the current position based on the provided indication.

As is discussed above, the position set input 165 provides a position set signal 165A to the controller 150, signaling when the controller 150 is to set the current position of the implement carrier 130 (i.e. the position of the lift arm 120 and the orientation of the implement carrier). In one embodiment, when controller 150 examines the signal 162A from the lift arm control input 162 when the position set signal 165A is received by the controller. The signal 162A from the lift arm control input 162 is used in conjunction with the position set signal 165A to determine whether the controller 150 should store a single pre-set target position or two pre-set target conditions.

When the operator actuates the position set input 165, the controller 150 begins by reading the signal 162A from the lift arm control input 162. During the time that the position set input 165 is actuated, the controller 150 will not provide control inputs 116, 118 to move the lift and tilt actuators 114, 124. Rather, movement of the lift arm control input 162 when the position set input 165 is actuated indicates how the current position is saved. If the lift arm control input 162 remains in a neutral position while the position set input 165 is actuated, the controller 150 determines that the operator intends to have a single pre-set target position. If the lift arm control input 162 is moved from the neutral position while the position set input 165 is actuated, the controller determines that the operator intends to have two pre-set target positions. If the operator moves the lift arm control input 162 in a way that would indicate an intention to lower the lift arm 120 when the position set input 165 is actuated, the current position of the implement carrier 130 is stored in a first position and during operation of the lift arm can only be accessed in block 245 (discussed in more detail below) when the lift arm 120 is currently positioned higher than the stored position. If, however, the operator moves the lift arm control input 162 in a way that would indicate an intention to raise the lift arm 120 when the position set input 165 is actuated, the current position of the implement carrier 130 is stored in a second position and during operation of the lift arm can only be accessed in block 245 when the lift arm 120 is currently positioned lower than the stored position.

Figure 7:
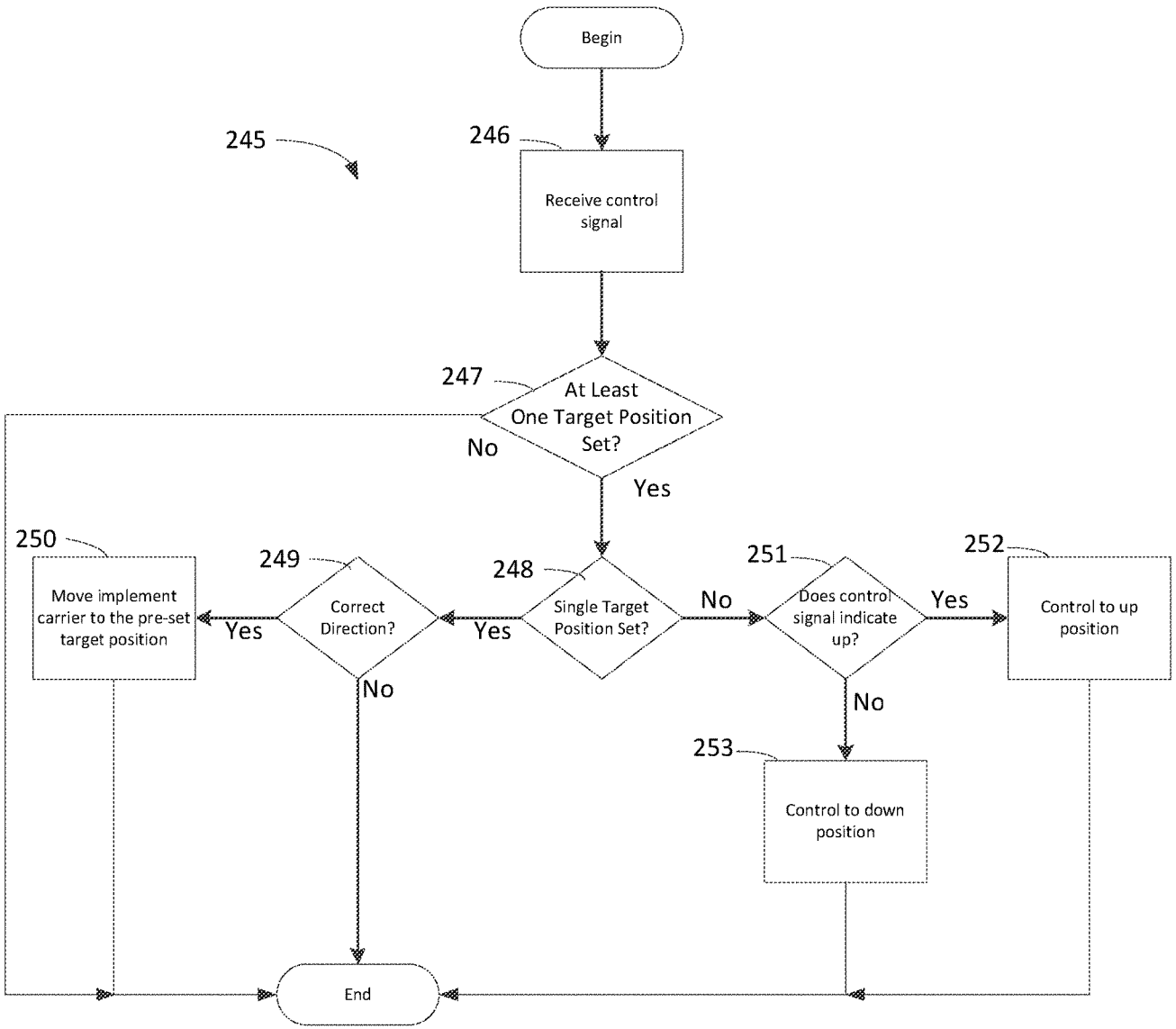
FIG. 7 is a flow chart illustrating a portion of the method of FIG. 5 where the implement carrier is returned to a pre-set target position.

FIG. 7 illustrates block 245, positioning of the implement carrier, in the third mode of operation, in more detail. At block 246, the controller 150 receives an enabling input signal 166A from the enabling input device 166. The enabling input signal 166A indicates to the controller 150 that it should be prepared to actuate the lift actuator 114 and the tilt actuator 124 to return the implement carrier to a pre-set target position. In one embodiment, the controller 150 will not cause the implement carrier 130 to be positioned to a pre-set target position in response only to the actuation of the enabling input device 166. The operator will also be required to actuate the lift arm control input 162 as well. Actuation of the lift arm control 162 will select a direction of lift arm travel as well as a speed of travel. Once both the enabling input signal 166A and a signal from the lift arm control input 162 have been received, the method is operating in a target mode.

At block 247, the controller 150 will check to make sure that at least one pre-set target positions has been stored. In one embodiment, the pre-set target positions are cleared at the beginning of a run cycle, and the method 245 will not operate to return to a position maneuver unless a pre-set target position has been previously stored. If no position is previously stored, no return to position maneuver is performed and the target mode is exited. If at least one position is set, the method moves to block 248, and the controller 150 checks to see if a single position is pre-set or if two positions are pre-set. If a single position is pre-set, the method moves to block 249 and determines whether the lift arm control input 162 is actuation in the correct direction. By correct direction, it is meant that the lift arm control input 162 should be actuated to drive the lift arm 120 toward the pre-set target position. The position of the lift arm 120 as measured by the lift arm sensor 126 is compared to the pre-set target position. If the lift arm sensor 126 indicates that the lift arm 120 is above the pre-set target position, the operator must be actuating the lift arm control input 162 to lower the lift arm 120. Conversely, if the lift arm 120 is positioned below the pre-set target position, the operator must be actuating the lift arm control input to raise the lift arm 120.

If it is determined that the operator is not actuating the lift arm control input in the correct direction, the target mode is exited and the position of the implement carrier is not changed, even though lift arm may move in response to actuation of the lift arm control input. If, however, it is determined that the operator is actuating the lift arm control input in the correct direction, the controller actuates the lift arm actuator 114 to move the lift arm toward its target position and the tilt actuator 124 as necessary to drive the implement carrier to the correct target orientation at block 250. The method remains in the target mode, moving toward the correct lift arm position and target orientation until these positions are achieved or the operator ceases to actuate the lift arm control input 162 or actuates the lift arm control input in the opposing direction. In any of these cases, the target mode is exited and movement of the lift arm and tilt are stopped until the lift arm control is returned to a neutral position and subsequently re-activated. In some embodiments, if the operator ceases to provide the enabling input signal 166A, the target mode is exited and movement of the lift arm is stopped. In some other embodiments, only the lift arm is moved toward a target position, with the tilt not being controlled in the target mode.

Figure 8:
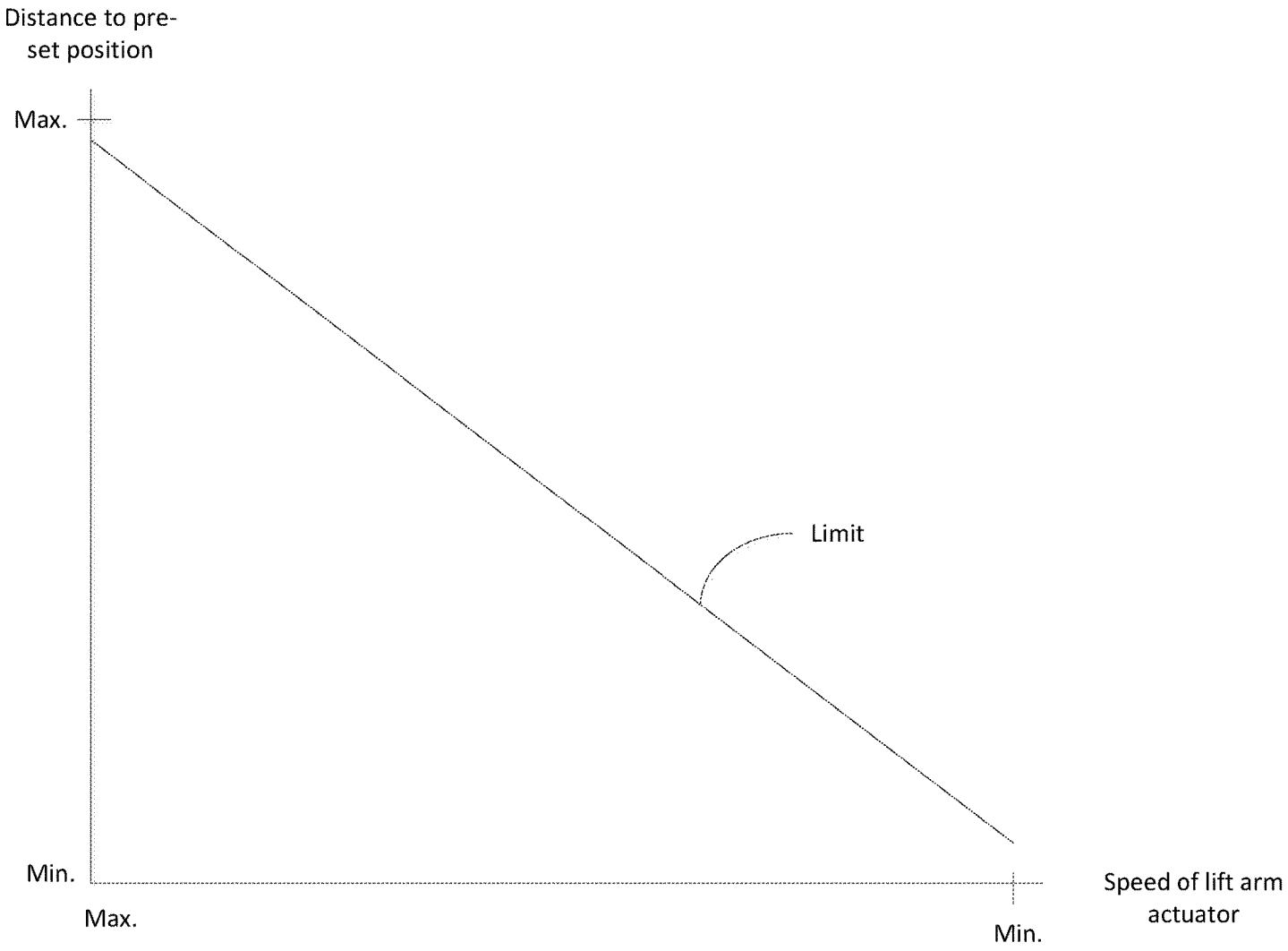
FIG. 8 is a graph illustrating a relationship between a distance from a pre-set lift arm position and the maximum allowable speed of a lift arm actuator.

The speed at which the lift arm actuator 114 and the tilt actuator 124 move is dependent on the amount that the operator actuates the lift arm control input 162, subject to a maximum allowable speed, which in some embodiments is always slower than the maximum allowable speed when not in a target mode. The more the lift arm actuator 162 is actuated, the faster the lift arm 120 and the implement carrier 130 are moved toward their respective pre-set target position and target orientation. As the lift arm 120 moves toward the pre-set target position, the maximum allowable speed decreases. FIG. 8 illustrates how the maximum allowable lift arm speed decreases linearly as the lift arm approaches the pre-set target position. In some embodiments, all movements toward a pre-set target position have a similar restriction on the maximum speed of the lift arm even as the operator maintain the ability to move the lift arm at a speed less than the maximum allowable speed by controlling the lift arm control input to set a speed up to the maximum allowable speed. Although it is discussed herein that moving to a targeted position includes controlling the position of the lift arm and the orientation tilt, in some embodiments, moving to the targeted position can include only controlling the lift arm until it reaches a targeted position, without regard for the position of the tilt orientation.

Returning to FIG. 7 and block 248 if the controller 150 has two pre-set target positions, the method moves to block 251. At block 251, the controller determines whether the control signal indicates an intention to raise the lift arm. If so, the method moves to block 252, where the controller 150 controls the lift arm 130 to move to the second, or higher of the pre-set lift arm target positions, provided that the lift arm position is lower than the pre-set target position. If, however, the controller determines that the control signal indicates an intention to the lift arm, the method moves to block 253, where the controller 150 controls the lift arm 130 to move to the first, or lower of the pre-set lift arm target positions, provided that the lift arm position is higher than the pre-set lower target position. In each case, the method enters a target mode and operates as described above to drive the lift arm toward a target position and, optionally, drive the tilt to a target orientation until an activity occurs (reaching the target, loss of a lift arm input) that causes the method to exit the target mode.

Figure 9:
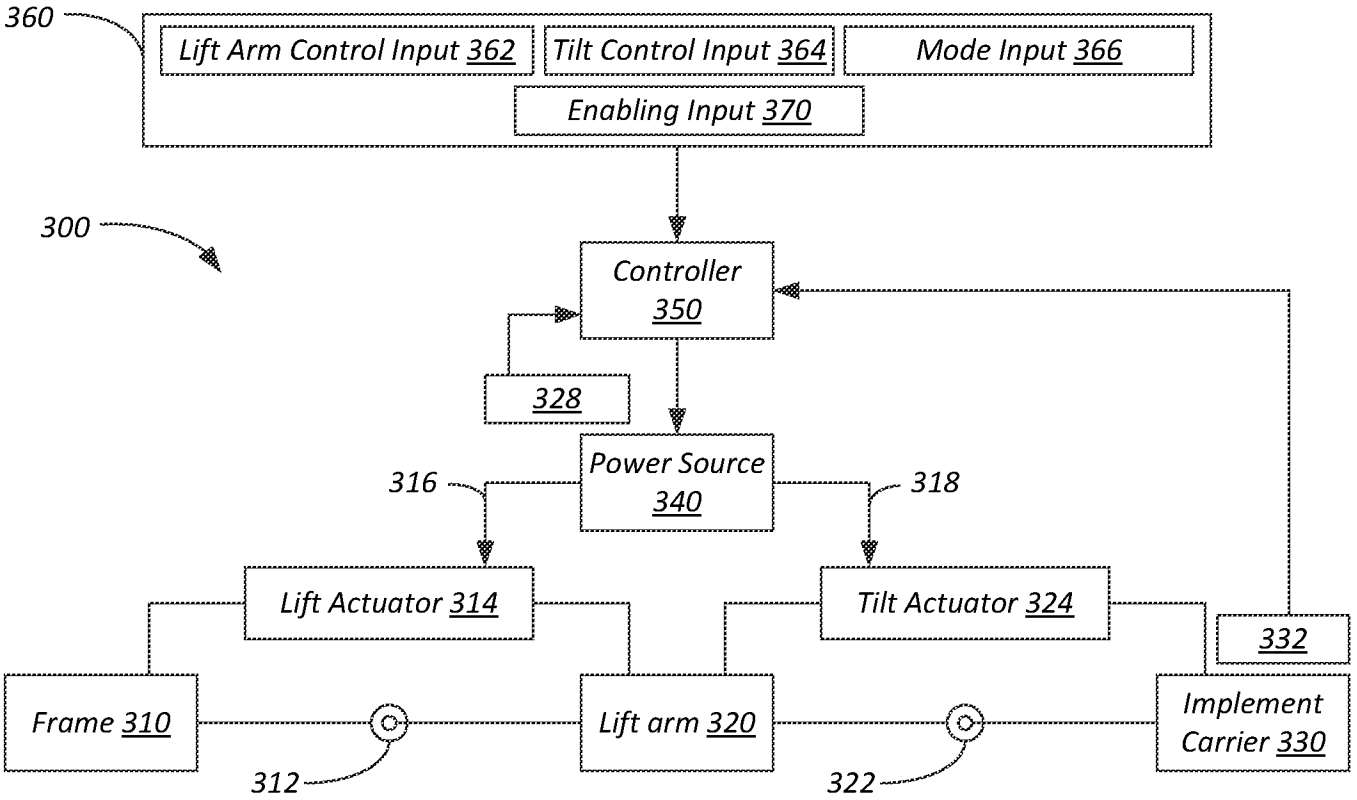
FIG. 9 is a block diagram illustrating components of a power machine that is capable of positioning an implement mounted to a lift arm according to another illustrative embodiment.

FIG. 9 illustrates a power machine 300 having a controller 350 for controlling a lift arm 320 and an implement carrier 330 according to another illustrative embodiment. The power machine 300 is similar to the power machine 100 in many aspects and similar components have similar reference numbers. For example, frame 310 is substantially similar to the frame 110. Power machine 300 has a lift arm 320 that is pivotally coupled to the frame 310 and an implement carrier 330 is attached to the lift arm 320. A lift actuator 314 is coupled to the frame 310 and the lift arm 320. The lift actuator 314 is operable to move the lift arm 320 relative to the frame 310. A tilt actuator 324 is coupled to the lift arm 320 and the implement carrier 330 and is operable to rotate the implement carrier 330 with respect to the lift arm 320.

A power source 340 is in communication with each of the lift actuator 314 and the tilt actuator 324, and couples a controller 350 to the lift and tilt actuators. The power source 340 provides control signals 316 and 318 for controlling the lift actuator 314 and the tilt actuator 324. An orientation sensor 332 provides a signal indicative of the orientation of the implement carrier 330 with respect to gravity. Stated another way, the orientation of implement carrier 330 with respect to gravity can be considered the orientation of implement carrier 330 with respect to a direction of Earth's gravitational force acting on the power machine, implement carrier and any attached implement. A pressure sensor 328 is in communication with the power source 340 and provides a signal to the controller 350 indicative of a pressure at a given position in the power source 340. As will be discussed below, the signal from pressure sensor 328 provides an indication of a load on the lift actuator 314 and can even indicate whether the lift actuator is being actuated. A plurality of user inputs 360 are capable of being manipulated by an operator to provide various control signals to the controller 350. The user inputs 360 can include inputs 362 and 364 for controlling the lift actuator 314 and the tilt actuator 324. In addition, one or more user inputs 360 are provided to allow an operator to select a mode for controlling positioning of the lift arm 320 and the implement carrier 330. For example, user inputs 360 can include a mode input 366 similar to mode input 164 discussed above. User inputs 360 can also include an enabling input 370 similar to enabling input 166 discussed above.

Figure 10:
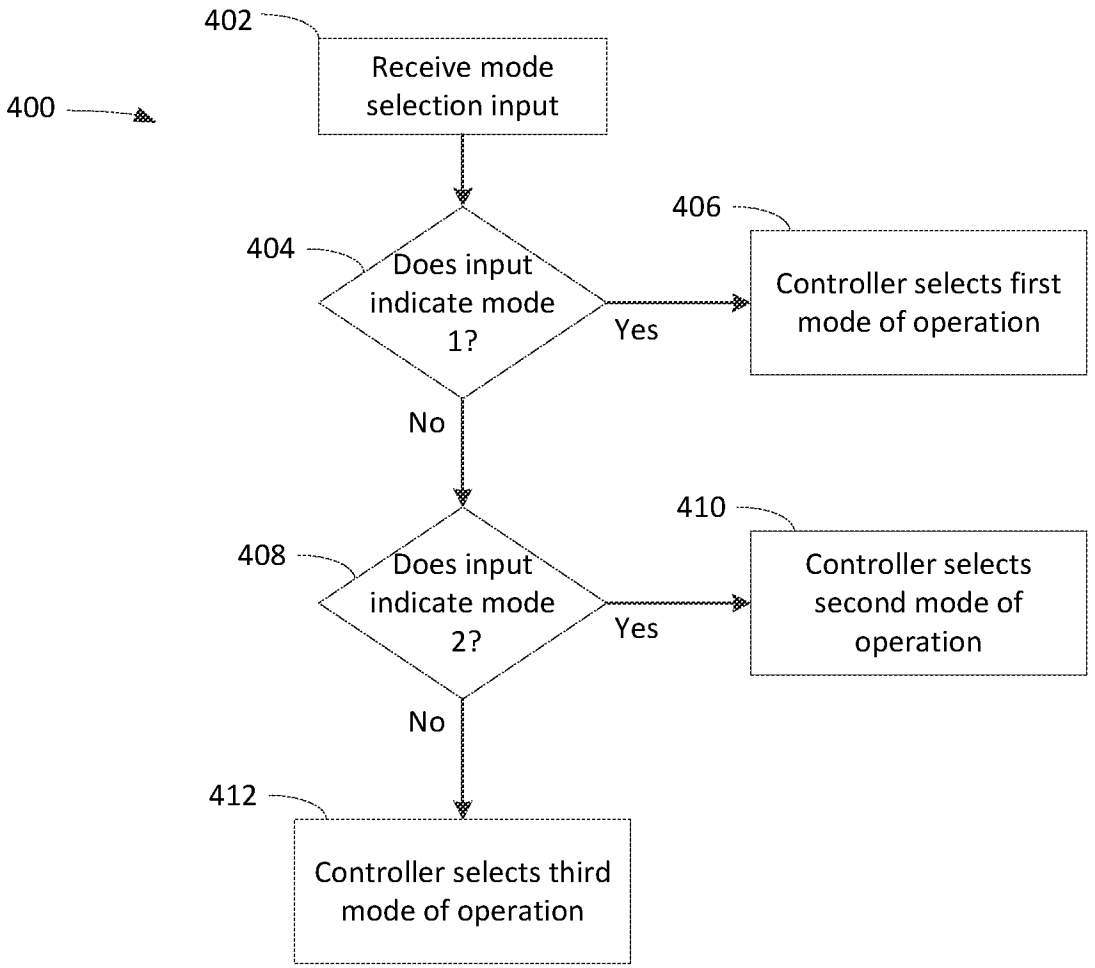
FIG. 10 is a flow chart illustrating a method of selecting a mode of operation for controlling a lift arm and/or implement carrier according to another illustrative embodiment.

FIG. 10 illustrates a method 400 of selecting a mode of operation for controlling the lift and tilt actuators of a power machine such as power machine 300. The method 400 is described with reference to power machine 300 for ease of explanation, but the method 400 can be incorporated with other power machines as well. At block 402, a mode signal for selecting a mode of operation is received from user inputs 360. Based on the signal received, the controller 350 will select one of three modes. At block 404, the method determines whether the mode signal indicates a first mode. If the first mode is indicated, the method moves to block 406. If the first mode is not indicated, the method moves to decision block 408. At block 406, the first mode is selected. When in the first mode, movement of the lift arm 320 is controlled by a lift arm input and movement of the implement carrier is controlled by a tilt input. In other words, the movement of the lift arm 320 and the implement carrier 330 are controlled only by the user inputs 360 designated as providing a control signal for the respective lift actuator 314 and the tilt actuator 324. In some embodiments, the first mode is the default mode of operation.

Returning to decision block 408, if the controller 350 determines that a second mode is indicated, the method moves to block 410. If the controller 350 determines that the second mode is not indicated, the method moves to block 412. At block 410, the second mode is selected. When in the second mode, the controller 350 operates to maintain a constant orientation of the implement carrier with respect to gravity as the lift arm is being raised and lowered in the absence of any control input from the operator. That is, when the operator manipulates a selected operator input 360 for actuating the lift arm actuator 314 to raise and lower the lift arm 320, and does not manipulate an input for manipulating the tilt actuator, the controller 350 actuates the tilt actuator 324 to maintain a constant orientation, as measured by sensor 332.

At block 412, the controller 350 selects a third mode of operation. In the third mode of operation, the controller 350 is capable, when receiving a signal, of lowering the lift arm 320 and moving the implement carrier 330 to a pre-defined orientation. The pre-defined orientation of the implement carrier can either be an orientation that is programmed into the controller 350 and is not adjustable, or be a selectable orientation set by the operator. In response to an activation signal from the operator, the controller 350 will provide signals 316 and 318 to the lift actuator 314 and the tilt actuator 324, respectively.

It should be noted that the power machine 300 does not include any sort of sensor that measures the position of the lift actuator 314 or the lift arm 320. However, pressure sensor 328, if properly placed within the power source 340, can sense when the lift arm 320 is fully lowered. More particularly, when the lift arm 320 is fully lowered against a mechanical stop, applying signal 316 to the lift actuator will not result in a buildup in hydraulic pressure. Thus, a low pressure sensed by sensor 328 when the lift actuator is being provided signal 316 would indicate that the lift arm is fully lowered. Because the controller 350 cannot affirmatively sense the exact position of the lift arm 320 or the lift actuator 314, returning to a position in the third mode is limited to returning to a fully lowered position of the lift arm, because it is only through a change in the pressure sensed by pressure sensor 328 and knowledge of which direction the lift actuator has been activated that the controller can deduce where the lift arm 320 is positioned—whether it is fully lowered.

It should be understood that the above described methods and power machines can be implemented in a wide variety of embodiments which encompass disclosed concepts. These various embodiments are within the scope of the disclosure, and the drawings and description should be interpreted as including such embodiments. Exemplary method and power machine embodiments are summarized below. Features of these summarized exemplary embodiments can be combined in various combinations by those of skill in the art, and such combinations are considered within the scope of the present disclosure.

In yet other embodiments, multiple position sensors such as inclinometers can be included such that the positions relative to gravity of the power machine, the lift arm, and/or the implement carrier can all be determined. In such embodiments, the lift arm and the implement carrier/implement can both be returned to predetermined positions or orientations relative to gravity even when the power machine is operating on uneven terrain. Using such sensors positioned on the power machine itself, on the lift arm, and on the implement or implement carrier, all of the above-discussed embodiments can be implemented in an alternative fashion.

With a first inclinometer positioned on the frame the power machine, the attitude of the machine frame can be known at all times during operation. With the baseline orientation of the power machine (e.g., the attitude of the machine on flat ground) and the lift arm geometry both being known, calculation of the position of the lift arm can be determined using current measurements of the orientation of the machine frame and lift arm. As the machine moves over uneven terrain, the orientation of the frame and lift arm will change, even though the lift arm has moved relative to the frame. However, since both orientations have changed, a controller will be able to compensate and determine the lift arm has maintained a constant position to the frame. Likewise, with a sensor on the implement or implement carrier, orientation relative to gravity can be controlled and maintained using the disclosed concepts.

Figure 11:
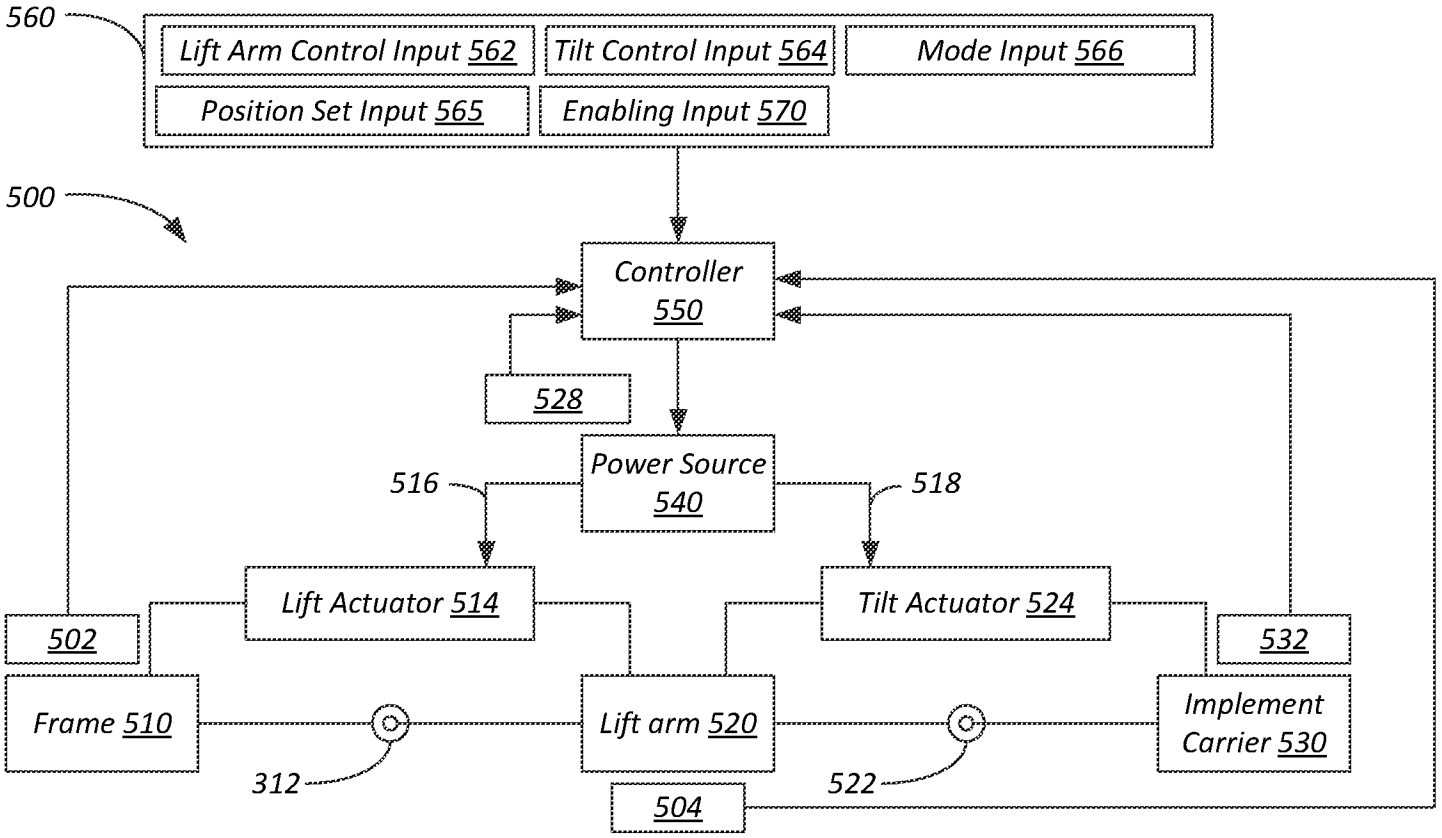
FIG. 11 is a block diagram illustrating components of another power machine embodiment, having inclinometers or orientation sensors coupled to each of the machine frame, a lift arm, and an implement carrier, configured to position an implement mounted to the lift arm according to another illustrative embodiment.

For example, referring to FIG. 11, shown is a block diagram illustrating a portion of a power machine 500 that is similar to power machine 300 discussed above with reference to FIG. 9. Power machine 500 includes, in addition to an inclinometer or position sensor 532 coupled to implement carrier 530, the above-disclosed additional inclinometers or orientation sensors 502 and 504, respectively, on the frame 510 and lift arm 520. The controller 550, which is similar in configuration to the above-discussed controllers to implement the above-discussed methods, is also configured to control the positions of lift arm 520 and/or implement carrier 530 based upon outputs from the three inclinometers 502, 504 and 532.

Referring more generally to components shown in FIG. 11, components of power machine 500 that are similar to components of power machine 300 have similar reference numbers. For example, frame 510 is substantially similar to the frame 310. Also like power machine 300, power machine 500 has the lift arm 520 that is pivotally coupled to the frame 510, with the implement carrier 530 attached to the lift arm 520. A lift actuator 514 is coupled to the frame 510 and the lift arm 520. The lift actuator 514 is operable to move the lift arm 520 relative to the frame 510. A tilt actuator 524 is coupled to the lift arm 520 and the implement carrier 530 and is operable to rotate the implement carrier 530 with respect to the lift arm 520. A power source 540 is in communication with each of the lift actuator 514 and the tilt actuator 524, and thus couples controller 550 to the lift and tilt actuators. The power source 540 provides control signals 516 and 518 for controlling the lift actuator 514 and the tilt actuator 524.

Similar to orientation sensor 332 discussed above, implement carrier orientation sensor 532 is optionally included to provide a signal indicative of the orientation of the implement carrier 530 with respect to gravity. Stated other ways, the orientation of implement carrier 530 with respect to gravity can be considered the orientation of implement carrier 530 with respect to a direction of Earth's gravitational force acting on the power machine, implement carrier and any attached implement. Alternatively, the implement carrier orientation sensor output can be indicative of an attitude of the implement carrier. Frame orientation sensor 502 is coupled to or mounted on frame 510 and is configured to provide a signal indicative of the orientation of frame 510 with respect to the gravitational direction or of the attitude of the frame. Lift arm orientation sensor 504 is coupled to or mounted on lift arm 520 and is configured to provide a signal indicative of the orientation of lift arm 520 with respect to the gravitational direction or of the attitude of the lift arm.

A pressure sensor 528 is in communication with the power source 540 and provides a signal to the controller 550 indicative of a pressure at a given position in the power source 540. The signal from pressure sensor 528 provides an indication of a load on the lift actuator 514 and can even indicate whether the lift actuator is being actuated. In the alternative, the pressure sensor can be indicative of a pressure in the tilt actuator 524. A plurality of user inputs 560, similar to user inputs 160 and 360 discussed above, are capable of being manipulated by an operator to provide various control signals to the controller 550. The user inputs 560 can include an input 562 for controlling the lift actuator 514 and an input 564 for controlling the tilt actuator 524. In addition, user inputs 560 can include set input 565 similar to set input 165 discussed above, a mode input 566 similar to mode inputs 164 and 366 discussed above, and an enabling input 570 similar to enabling inputs 166 and 370 discussed above.

As discussed, controller 550 is coupled to and receives inputs from each of the lift arm control input 562 to receive the lift arm control signal, to the tilt control input 564 to receive the tilt control signal, to the frame orientation sensor 502 to receive the frame orientation sensor output, to the lift arm orientation sensor 504 to receive the lift arm orientation sensor output, and to the implement orientation sensor 532 to receive the implement orientation sensor output. The controller is also coupled to the power source 540 to control the power source control signals 516 and 518 to control the lift arm actuator 514 and the tilt actuator 524 to move or return the lift arm 520 or the implement carrier 530 to predetermined orientations relative to a gravitational direction or a reference attitude. Using the outputs of the three orientation sensors, with the baseline orientation of the power machine and the lift arm geometry both being known, controller 550 is configured to calculate the position of the lift arm and/or of the implement carrier. Thus, even as the machine moves over uneven terrain and the orientations of the frame and lift arm change, controller 550 can compensate and control the lift arm and implement carrier positions accordingly. In some embodiments, using the implement orientation sensor output, the controller 550 controls the tilt actuator to cause the implement carrier to move to a predetermined orientation (which may be predetermined as described above in the various modes of operation that are discussed) and, once moved to the predetermined orientation, maintains the predetermined orientation even as the lift arm actuator moves the lift arm to a predetermined position (which may also be predetermined as described above in the various modes of operation that are discussed).

While an implement carrier 530, an implement carrier orientation sensor 532, a tilt actuator 524 and a tilt control input are illustrated in FIG. 11, not all of these components are required in all embodiments. For example, in embodiments in which an implement carrier orientation sensor 532 is omitted, controller 550 can be configured to calculate a position of the lift arm relative to the frame based on the frame orientation sensor output and the lift arm orientation sensor output. The controller can also be configured to control the power source control signals, and thereby control the lift arm actuator to move the lift arm to a predetermined position, based upon this calculation without the use of an implement carrier orientation sensor. FIG. 11 must be interpreted as including such embodiments.

In an example embodiment, with enabling input device 570 manipulated by the power machine operator an activation signal is provided to controller 550. In this embodiment, the configuration of the controller is such that the controller controls the lift arm actuator 514 and the tilt actuator 524, in response to receiving both of the activation signal and the lift arm control signal, to move the lift arm to a target lift arm position and optionally to move the implement carrier to a target implement carrier orientation relative to the gravitational direction. In the alternative, the controller controls the tilt actuator to maintain the implement carrier at the target implement carrier orientation as the lift arm is moved. Thus, the lift arm actuator and the tilt actuator are controlled as a function of all three of the frame orientation sensor output, the lift arm orientation sensor output, and the implement orientation sensor output.

In another example embodiment, the controller 550 is further configured to control the lift arm actuator 514 and the tilt actuator 524 by determining whether the tilt control signal from tilt control input 564 is indicative of a neutral or non-neutral position of the tilt control input, and maintaining the target implement carrier orientation relative to the gravitational direction, when the lift arm control signal from input 562 commands movement of the lift arm and the tilt control input 564 is in the neutral position, by controlling the lift arm actuator 514 in response to the lift arm control signal to move the lift arm and by controlling the tilt actuator 524 to maintain the target implement carrier orientation relative to the gravitational direction while the lift arm is moving. In some such embodiments, the controller 550 is further configured to control the lift arm actuator and the tilt actuator by moving the tilt actuator when the tilt control input is not in the neutral position and responsively changing the target implement carrier orientation.

In some embodiments, with pressure sensor 528 providing a signal indicative of a pressure in at least one of the power source 540, the lift actuator 514 and the tilt actuator 524, controller 550 can be further configured to control the lift arm actuator and the tilt actuator by: (1) determining whether the pressure sensor signal is indicative of a pressure above a threshold pressure; (2) controlling the lift arm actuator in response to the lift arm control signal from control input 562 when the lift arm control input is in the non-neutral position to move the lift arm; and (3) controlling the tilt actuator to maintain the target implement carrier orientation relative to the gravitational direction while the tilt control input 564 is in the neutral position and the lift arm is moving if the pressure sensor signal is not indicative of the pressure being above the threshold pressure, and if the pressure signal is indicative of the pressure being above the threshold pressure, stopping actuation of the tilt actuator.

In some embodiments, the set input device 565 is configured to be manipulated by the power machine operator to provide a position set signal and the controller is configured to set the first target lift arm position and the first target implement carrier orientation responsive to the position set signal. Further, in some embodiments, the target lift arm position is a first target lift arm position out of at least two target lift arm positions. In such an embodiment, the lift arm control signal from input 562 can include a direction component corresponding to a direction of actuation of the lift arm control input commanding the lift arm to be raised or lowered. The controller 550 can then be configured to identify or select one of the first target lift arm position and a second target lift arm position based upon the direction component of the lift arm control signal. The controller 550 can be configured to control the lift arm actuator responsive to receipt of both of the activation signal and the lift arm control signal to move the lift arm towards the identified or selected one of the first and second target lift arm positions.

Although the present invention has been described with reference to preferred embodiments, workers skilled in the art will recognize that changes may be made in form and detail to the disclosed embodiments without departing from the spirit and scope of the concepts discussed herein.

What is claimed is:

1. A power machine comprising:

a frame;

a frame orientation sensor configured to provide a frame orientation sensor output indicative of an orientation of the frame relative to a gravitational direction;

a lift arm pivotably coupled to the frame;

a lift arm actuator coupled between the frame and the lift arm to control movement of the lift arm relative to the frame;

a lift arm orientation sensor configured to provide a lift arm orientation sensor output indicative of an orientation of the lift arm relative to the gravitational direction;

a power source in communication with the lift arm actuator and configured to provide power source control signals to control the lift arm actuator;

a lift arm control input configured to be manipulated by a power machine operator to provide a lift arm control signal; and a controller coupled to the lift arm control input to receive the lift arm control signal, to the frame orientation sensor to receive the frame orientation sensor output, and to the lift arm orientation sensor to receive the lift arm orientation sensor output, wherein the controller is configured to calculate a position of the lift arm relative to the frame based on the frame orientation sensor output and the lift arm orientation sensor output and wherein the controller is further coupled to the power source to control the power source control signals and thereby control the lift arm actuator to move the lift arm to a predetermined position.

2. The power machine of claim 1 and further comprising: an implement carrier pivotably coupled to the lift arm;

a tilt actuator coupled to the between the lift arm and the implement carrier to control movement of the implement carrier relative to the lift arm and in communication with the power source so that the power source can provide control signals to the tilt actuator; and an implement orientation sensor configured to provide an implement orientation sensor output indicative of an orientation of the implement carrier relative to the gravitational direction;

wherein the controller is coupled to the implement orientation sensor to receive the implement orientation sensor output and to the tilt actuator to cause the implement carrier to move to a predetermined orientation and, once moved to the predetermined orientation, maintaining the predetermined orientation even as the lift arm actuator moves the lift arm to the predetermined position.

3. The power machine of claim 1, and further comprising an enabling input device configured to be manipulated by the power machine operator to provide an activation signal, wherein the controller is further coupled to the enabling input device to receive the activation signal, and wherein the controller is further configured to control the lift arm actuator responsive to receipt of both of the activation signal and the lift arm control signal to move the lift arm to a target lift arm position relative to the gravitational direction.

4. The power machine of claim 3, wherein the controller is configured to control the lift arm actuator and the tilt actuator as a function of the frame orientation sensor output, the lift arm orientation sensor output, and the implement orientation sensor output.

5. The power machine of claim 3, wherein the frame orientation sensor is coupled to the frame, the lift arm orientation sensor is coupled to the lift arm, and the implement orientation sensor is coupled to the implement carrier.

6. The power machine of claim 3, wherein the implement orientation sensor is configured to provide the implement orientation sensor output such that the implement orientation sensor output is further indicative of an orientation of an implement, attached to the implement carrier, relative to the gravitational direction.

7. The power machine of claim 3, wherein the controller is further configured to control the lift arm actuator and the tilt actuator by:

determining whether the tilt control signal is indicative of a neutral or non-neutral position of the tilt control input; and maintaining the target implement carrier orientation relative to the gravitational direction, when the lift arm control signal commands movement of the lift arm and the tilt control input is in the neutral position, by controlling the lift arm actuator in response to the lift arm control signal to move the lift arm and by controlling the tilt actuator to maintain the target implement carrier orientation relative to the gravitational direction while the lift arm is moving.

8. The power machine of claim 7, wherein the controller is further configured to control the lift arm actuator and the tilt actuator by moving the tilt actuator when the tilt control input is not in the neutral position and responsively changing the target implement carrier orientation.

9. The power machine of claim 8, and further comprising a pressure sensor configured to provide a pressure sensor signal indicative of a pressure in at least one of the power source and the tilt actuator, wherein the controller is further configured to control the lift arm actuator and the tilt actuator by:

determining whether the pressure sensor signal is indicative of a pressure above a threshold pressure;

controlling the lift arm actuator in response to the lift arm control signal when the lift arm control input is in the non-neutral position to move the lift arm; and controlling the tilt actuator to maintain the target implement carrier orientation relative to the gravitational direction while the tilt control input is in the neutral position and the lift arm is moving if the pressure sensor signal is not indicative of the pressure being above the threshold pressure, and if the pressure signal is indicative of the pressure being above the threshold pressure, stopping actuation of the tilt actuator.

10. The power machine of claim 3, wherein the controller is configured to control the lift arm actuator to control speed of movement of the lift arm based upon the lift arm control signal from the lift arm control input.

11. The power machine of claim 3, wherein the target lift arm position is a first target lift arm position, and further comprising a position set input device configured to be manipulated by the power machine operator to provide a position set signal, and wherein the controller is further configured to set the first target lift arm position and the first target implement carrier orientation responsive to the position set signal.

12. The power machine of claim 11, wherein the lift arm control signal includes a direction component corresponding to a direction of actuation of the lift arm control input commanding the lift arm to be one of raised and lowered, and wherein the controller is configured to identify one of the first target lift arm position and a second lift arm position based upon the direction component of the lift arm control signal, wherein the controller is configured to control the lift arm actuator responsive to receipt of both of the activation signal and the lift arm control signal to move the lift arm towards the identified one of the first and second target lift arm positions.

* * * * *